US009971369B1

(12) United States Patent
Chen et al.

(10) Patent No.: US 9,971,369 B1
(45) Date of Patent: May 15, 2018

(54) VOLTAGE REGULATOR

(71) Applicant: FARADAY TECHNOLOGY CORPORATION, Hsinchu (TW)

(72) Inventors: Chi-Yang Chen, Hsinchu (TW); Wen-Chi Huang, Hsinchu (TW)

(73) Assignee: Faraday Technology Corp., Hsin-Chu (TW)

( * ) Notice: Subject to any disclaimer, the term of this patent is extended or adjusted under 35 U.S.C. 154(b) by 0 days. days.

(21) Appl. No.: 15/496,129

(22) Filed: Apr. 25, 2017

(30) Foreign Application Priority Data

Mar. 3, 2017 (TW) ..... 106107087 A

(51) Int. Cl.
*G05F 1/46* (2006.01)

(52) U.S. Cl.
CPC ..... *G05F 1/468* (2013.01)

(58) Field of Classification Search
CPC ..... G05F 1/461; G05F 1/468
See application file for complete search history.

(56) References Cited

U.S. PATENT DOCUMENTS 5,608,312 A 3/1997 Wallace
6,429,716 B1 * 8/2002 Drapkin ..... H03K 19/00315 323/313
6,479,972 B1 11/2002 Chen
7,002,379 B2 2/2006 Ajit
7,570,088 B1 * 8/2009 Ku ..... H03K 19/00315 326/81
7,714,553 B2 5/2010 Lou
7,843,222 B1 * 11/2010 Shiah ..... H03K 19/00315 326/81

FOREIGN PATENT DOCUMENTS

TW 201306479 2/2013

OTHER PUBLICATIONS

Taiwan Intellectual Property Office, "Office Action", dated Nov. 24, 2017.

* cited by examiner

*Primary Examiner* — Jeffrey Zweizig
(74) *Attorney, Agent, or Firm* — Winston Hsu

(57) ABSTRACT

A voltage regulator is connected with an input/output circuit. The voltage regulator includes a controlling circuit, a sink voltage generator and a source voltage generator. The controlling circuit generates a first reference voltage, a second reference voltage, a first power start control signal and a second power start control signal. The sink voltage generator receives the first reference voltage and the first power start control signal. The source voltage generator receives the second reference voltage and the second power start control signal. When the voltage regulator is in a normal working state, the controlling circuit inactivates the first power start control signal and the second power start control signal, the sink voltage generator generates a sink voltage according to the first reference voltage, and the source voltage generator generates a source voltage according to the second reference voltage.

9 Claims, 5 Drawing Sheets

VOLTAGE REGULATOR

This application claims the benefit of Taiwanese Patent Application No. 106107087, filed Mar. 3, 2017, the subject matter of which is incorporated herein by reference.

FIELD OF THE INVENTION

The present invention relates to a voltage regulator, and more particularly to a source and sink voltage regulator for a cascade I/O circuit.

BACKGROUND OF THE INVENTION

For increasing the operating speed and reducing the power consumption, the circuitry of an integrated circuit (IC) chip usually comprises transistors that withstand low voltages. For example, the IC chip comprises 1.8V transistors.

Since an output pad of the IC chip provides a higher output voltage (e.g., 3.3V), the 1.8V transistors of the I/O circuit are in a cascade connection.

For example, in the I/O circuit, two P-type transistors in the cascade connection are connected between a power voltage (3.3V) and the output pad. If the I/O circuit provides 0V to the output pad, the source-drain voltages of the P-type transistors are within the withstanding voltage range (i.e., 1.8V).

Similarly, in the I/O circuit, two N-type transistors in the cascade connection are connected between the output pad and a ground voltage (GND). If the I/O circuit provides 3.3V to the output pad, the source-drain voltages of the N-type transistors are within the withstanding voltage range (i.e., 1.8V.)

However, the conventional I/O circuit still has some drawbacks. For example, it is necessary to properly control the gate voltages of the P-type transistors or the N-type transistors. If the gate voltages are not properly controlled, the gate-source voltages of the transistors are possibly beyond the withstanding voltage range and thus the transistors are burnt out.

SUMMARY OF THE INVENTION

An embodiment of the present invention provides a voltage regulator. The voltage regulator is connected with an input/output circuit. The voltage regulator includes a controlling circuit, a sink voltage generator and a source voltage generator. The controlling circuit generates a first reference voltage, a second reference voltage, a first power start control signal and a second power start control signal. The sink voltage generator receives the first reference voltage and the first power start control signal. The source voltage generator receives the second reference voltage and the second power start control signal. When the voltage regulator is in a normal working state, the controlling circuit inactivates the first power start control signal and the second power start control signal, the sink voltage generator generates a sink voltage according to the first reference voltage, and the source voltage generator generates a source voltage according to the second reference voltage.

Numerous objects, features and advantages of the present invention will be readily apparent upon a reading of the following detailed description of embodiments of the present invention when taken in conjunction with the accompanying drawings. However, the drawings employed herein are for the purpose of descriptions and should not be regarded as limiting.

BRIEF DESCRIPTION OF THE DRAWINGS

The above objects and advantages of the present invention will become more readily apparent to those ordinarily skilled in the art after reviewing the following detailed description and accompanying drawings, in which.

DETAILED DESCRIPTION OF PREFERRED EMBODIMENTS

Figure 1:
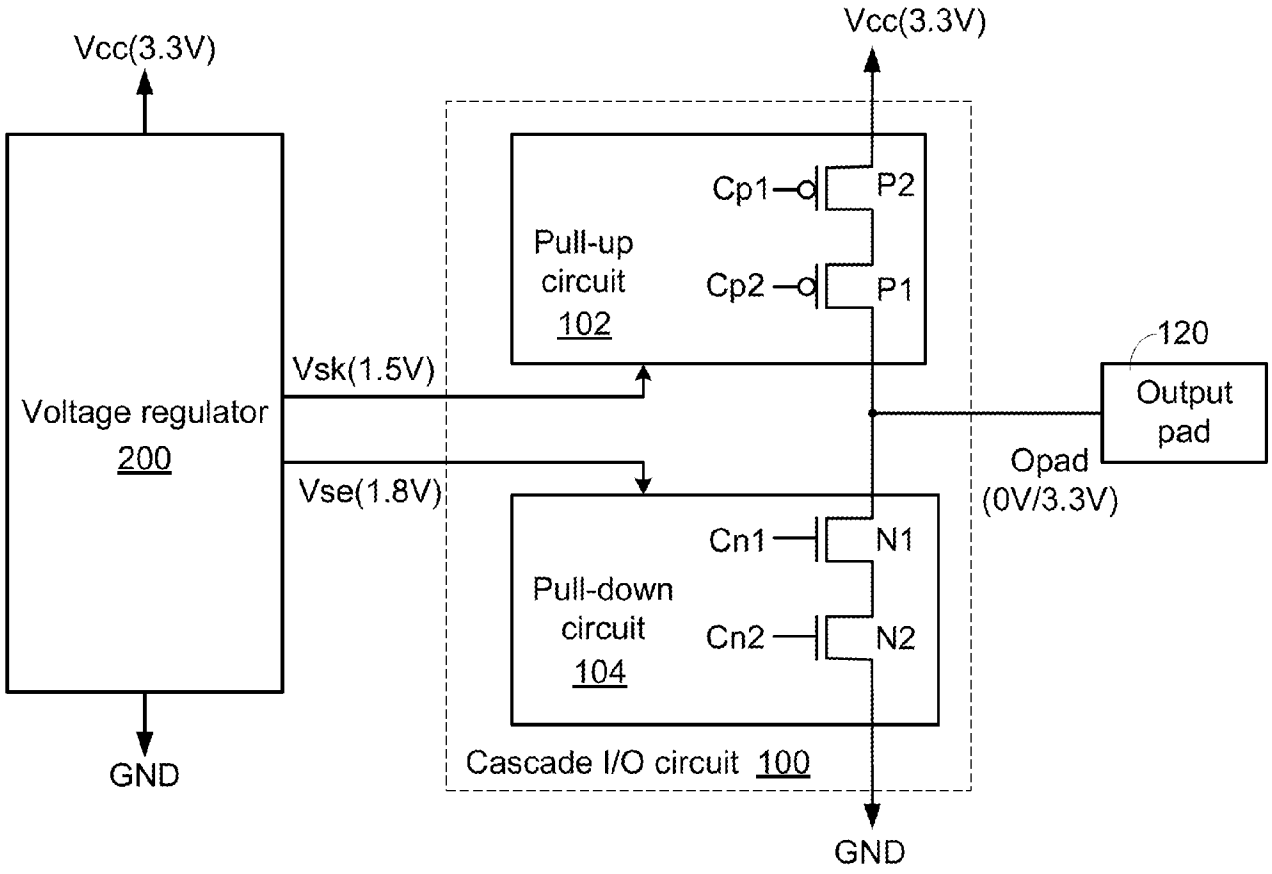
FIG. 1 is a schematic circuit diagram illustrating a voltage regulator for a cascade I/O circuit according to an embodiment of the present invention.

FIG. 1 is a schematic circuit diagram illustrating a voltage regulator for a cascade I/O circuit according to an embodiment of the present invention. As shown in FIG. 1, the cascade input/out (I/O) circuit 100 comprises a pull-up circuit 102 and a pull-down circuit 104.

The pull-up circuit 102 comprises two P-type transistors P1 and P2 in a cascade connection. The two P-type transistors P1 and P2 are connected between a power voltage Vcc and an output pad 120. Moreover, the gate terminals of the P-type transistors P1 and P2 receive gate signals Cp1 and Cp2, respectively.

The pull-down circuit 104 comprises two N-type transistors N1 and N2 in a cascade connection. The two N-type transistors N1 and N2 are connected between the output pad 120 and a ground voltage GND.

Moreover, the gate terminals of the N-type transistors N1 and N2 receive gate signals Cn1 and Cn2, respectively.

When the cascade I/O circuit 100 intends to output a power voltage Vcc to the output pad 120, the pull-up circuit 102 activates the gate signals Cp1 and Cp2 to turn on the P-type transistors P1 and P2. Consequently, the power voltage Vcc is transmitted to the output pad 120. Meanwhile, the pull-down circuit 104 turns off the conduction path between the output pad 120 and the ground voltage GND.

When the cascade I/O circuit 100 intends to output the ground voltage GND to the output pad 120, the pull-down circuit 104 activates the gate signals Cn1 and Cn2 to turn on the N-type transistors N1 and N2. Consequently, the ground voltage GND is transmitted to the output pad 120. Meanwhile, the pull-up circuit 102 turns off the conduction path between the output pad 120 and the power voltage Vcc.

If the gate signal Cp1 or Cp2 generated by the pull-up circuit 102 is improper, the source-drain voltage of the P-type transistor P1 or P2 is possibly beyond the withstanding voltage range. For avoiding this problem, the voltage regulator 200 provides a sink voltage Vsk (e.g., 1.5V) to the pull-up circuit 102. The sink voltage Vsk is used as the lowest voltage level of the pull-up circuit 102. Consequently, the operating voltages of all signals of the pull-up circuit 102 are in a range between the power voltage Vcc and the sink voltage Vsk.

Similarly, if the gate signal Cn1 or Cn2 generated by the pull-down circuit 104 is improper, the source-drain voltage of the N-type transistors N1 or N2 is possibly beyond the withstanding voltage range. For avoiding this problem, the voltage regulator 200 provides a source voltage Vse (e.g., 1.8V) to the pull-down circuit 104. The source voltage Vse is used as the highest voltage level of the pull-down circuit 104. Consequently, the operating voltages of all signals of the pull-down circuit 104 are in a range between the source voltage Vse and the ground voltage GND.

That is, in the normal working state, the voltage regulator 200 provides the sink voltage Vsk to the pull-up circuit 102. Consequently, in the pull-up circuit 102, the highest voltage level is the power voltage Vcc and the lowest voltage level is the sink voltage Vsk. Similarly, in the normal working state, the voltage regulator 200 provides the source voltage Vse to the pull-down circuit 104. Consequently, in the pull-down circuit 104, the highest voltage level is the source voltage Vse and the lowest voltage level is the ground voltage GND.

The operations of the cascade I/O circuit 100 will be described as follows. For example, the power voltage Vcc is 3.3V, the sink voltage Vsk is 1.5V, the source voltage Vse is 1.8V, and the ground voltage GND is 0V.

When the cascade I/O circuit 100 outputs the power voltage Vcc (3.3V) to the output pad 120, the gate signals Cp1 and Cp2 of the pull-up circuit 102 are both equal to the sink voltage Vsk (1.5V). Since the P-type transistors P1 and P2 are turned on, the power voltage Vcc is transmitted to the output pad 120. Meanwhile, the gate signal Cn1 and Cn2 of the pull-down circuit 104 are equal to the source voltage Vse (1.8V) and the ground voltage GND (0V), respectively. Consequently, the conduction path between the output pad 120 and the ground voltage GND is turned off.

When the cascade I/O circuit 100 outputs the ground voltage GND (0V) to the output pad 120, the gate signal Cn1 and Cn2 of the pull-down circuit 104 are both equal to the source voltage Vse (1.8V). Since the N-type transistors N1 and N2 are turned on, the ground voltage GND (0V) is transmitted to the output pad 120. Moreover, in the pull-up circuit 102, the gate signal Cp2 and Cp1 are equal to the sink voltage Vsk (1.5V) and the power voltage Vcc (3.3V), respectively. Consequently, the conduction path between the output pad 120 and the power voltage Vcc is turned off.

From the above descriptions, the voltage between any two terminals of the P-type transistor P1, the P-type transistor P2, the N-type transistor N1 or the N-type transistor N2 does not exceed the withstanding voltage range regardless of whether the output pad 120 outputs the high voltage (3.3V) or the low voltage (0V).

Figure 2:
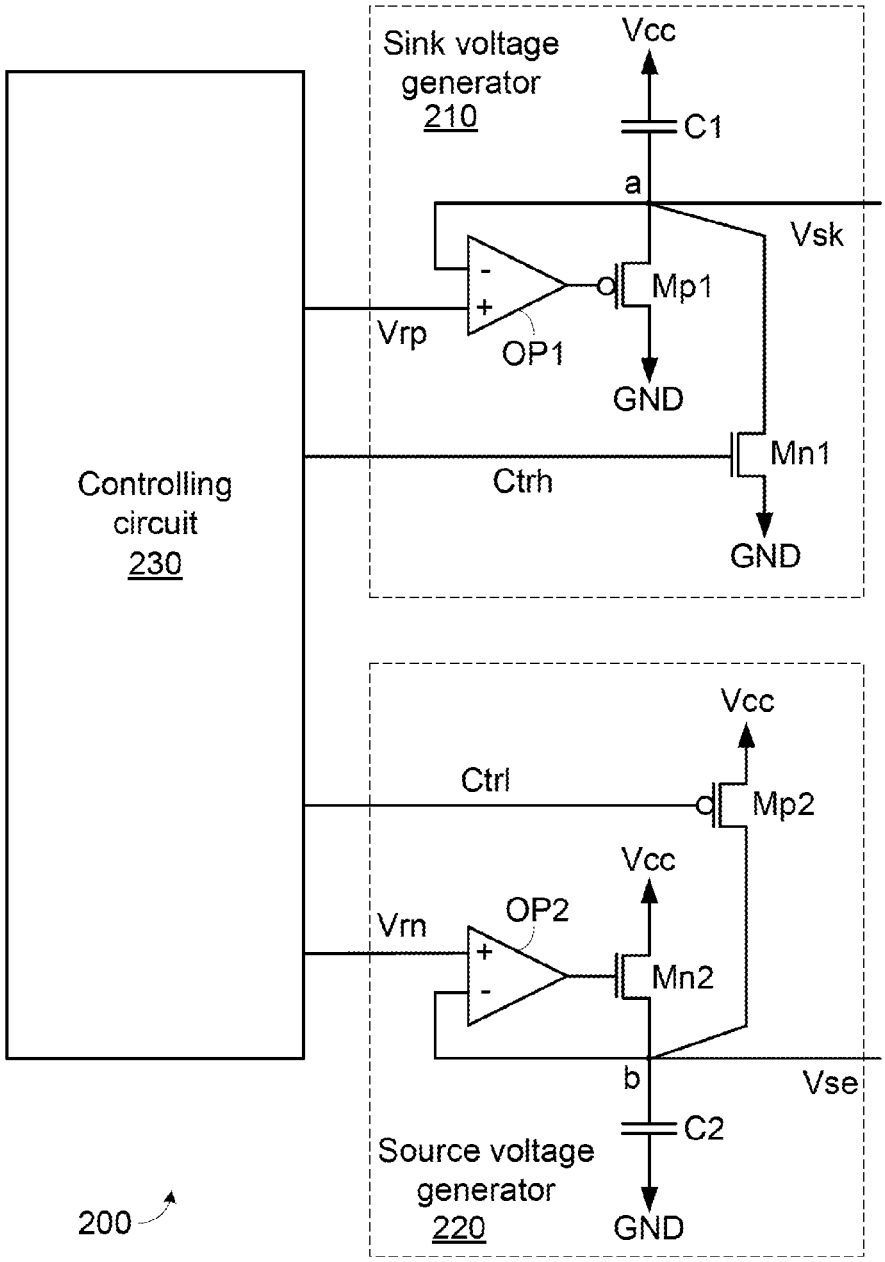
FIG. 2 is a schematic circuit diagram illustrating the detailed circuitry of the voltage regulator according to the embodiment of the present invention.

FIG. 2 is a schematic circuit diagram illustrating the detailed circuitry of the voltage regulator according to the embodiment of the present invention. As shown in FIG. 2, the voltage regulator 200 comprises a sink voltage generator 210, a source voltage generator 220 and a controlling circuit 230.

The sink voltage generator 210 comprises an operational amplifier OP1, a capacitor C1, a transistor Mp1 and a transistor Mn1. A positive input terminal of the operational amplifier OP1 receives a reference voltage Vrp. A negative input terminal of the operational amplifier OP1 is connected with a node a. The capacitor C1 is connected between the power voltage Vcc and the node a. The gate terminal of the transistor Mp1 is connected with an output terminal of the operational amplifier OP1. A first terminal of the transistor Mp1 is connected with the node a. A second terminal of the transistor Mp1 is connected with the ground voltage GND. The gate terminal of the transistor Mn1 receives a power start control signal Ctrh. A first terminal of the transistor Mn1 is connected with the node a. A second terminal of the transistor Mn1 is connected with the ground voltage GND. Moreover, the node a generates the sink voltage Vsk.

The source voltage generator 220 comprises an operational amplifier OP2, a capacitor C2, a transistor Mp2 and a transistor Mn2. A positive input terminal of the operational amplifier OP2 receives a reference voltage Vrm. A negative input terminal of the operational amplifier OP2 is connected with a node b. The capacitor C2 is connected between the ground voltage GND and the node b. The gate terminal of the transistor Mn2 is connected with an output terminal of the operational amplifier OP2. A first terminal of the transistor Mn2 is connected with the node b. A second terminal of the transistor Mn2 is connected with the power voltage Vcc. The gate terminal of the transistor Mp2 receives a power start control signal Ctrl. A first terminal of the transistor Mp2 is connected with the node b. A second terminal of the transistor Mp2 is connected with the ground voltage Vcc. Moreover, the node b generates the source voltage Vse.

In the normal working state of the voltage regulator 200, the controlling circuit 230 inactivates the power start control signals Ctrh and Ctrl. Moreover, the controlling circuit 230 provides the reference voltages Vrp and Vrn to the sink voltage generator 210 and the source voltage generator 220, respectively. According to the reference voltage Vrp, the sink voltage generator 210 generates the sink voltage Vsk. According to the reference voltage Vrn, the source voltage generator 220 generates the source voltage Vse. For example, if the reference voltage Vrp is 1.5V, the sink voltage generator 210 generates the sink voltage Vsk of 1.5V. Similarly, if the reference voltage Vrn is 1.8V, the source voltage generator 220 generates the source voltage Vse of 1.8V.

After the voltage regulator 200 is powered on and during a transient period of the voltage regulator 200, the controlling circuit 230 activates the power start control signals Ctrh and Ctrl. Under this circumstance, the ground voltage GND is temporarily used as the sink voltage Vsk by the sink voltage generator 210, and the power voltage Vcc is temporarily used as the source voltage Vse by the source voltage generator 220.

After the voltage regulator 200 is powered on and during the transient period of the voltage regulator 200, the transistor Mn1 of the sink voltage generator 210 is turned on and thus the ground voltage GND is used as the sink voltage Vsk. In addition, the transistor Mp2 of the source voltage generator 220 is turned on, and thus the power voltage Vcc is used as the source voltage Vse.

In the normal working state of the voltage regulator 200, the transistor Mn1 of the sink voltage generator 210 is turned off. Since the operational amplifier OP1 and the transistor Mp1 are in a negative feedback connection, the sink voltage Vsk is equal to the reference voltage Vrp. In addition, the transistor Mp2 of the source voltage generator 220 is turned off. Since the operational amplifier OP2 and the transistor Mn2 are in a negative feedback connection, the source voltage Vse is equal to the reference voltage Vrn. For example, if the reference voltage Vrp is 1.5V, the sink voltage generator 210 generates the sink voltage Vsk of 1.5V. Similarly, if the reference voltage Vrn is 1.8V, the source voltage generator 220 generates the source voltage Vse of 1.8V.

Figure 3A:
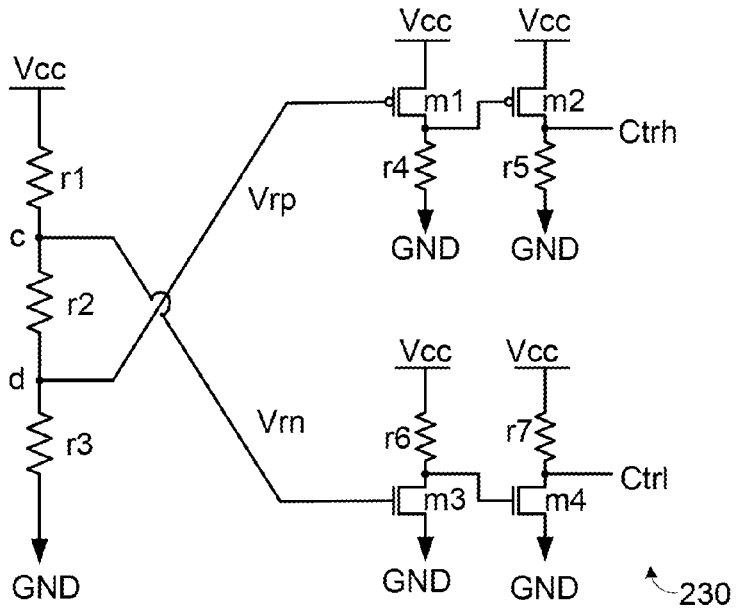
FIG. 3A is a schematic circuit diagram illustrating the controlling circuit of the voltage regulator according to the embodiment of the present invention.
Figure 3B:
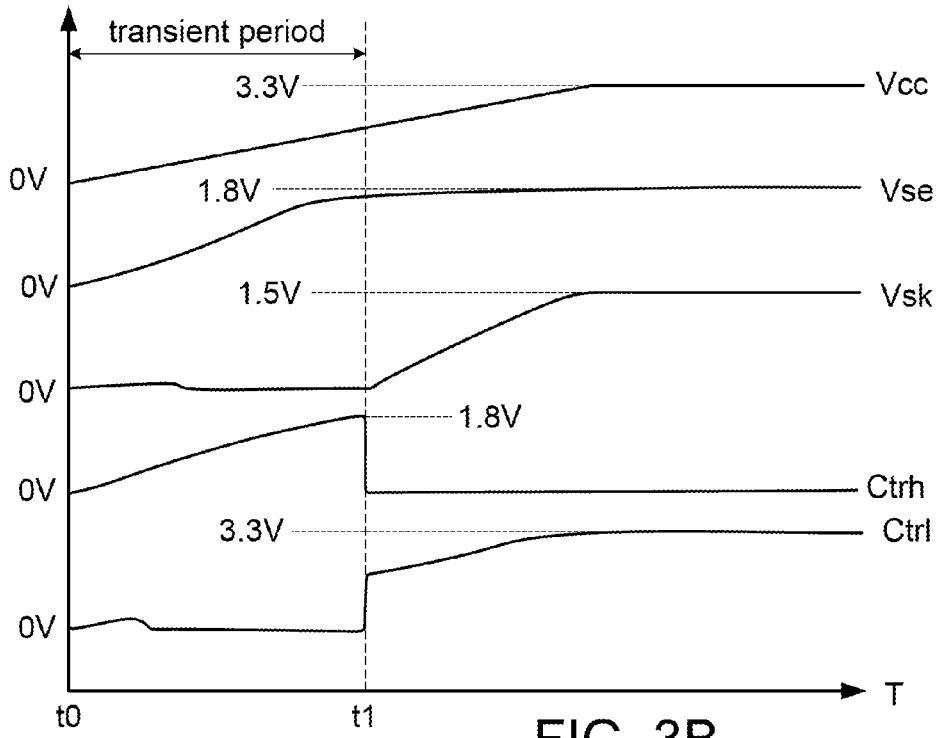
FIG. 3B is a schematic timing waveform diagram illustrating associated signal processed by the voltage regulator according to the embodiment of the present invention.

FIG. 3A is a schematic circuit diagram illustrating the controlling circuit of the voltage regulator according to the embodiment of the present invention. FIG. 3B is a schematic timing waveform diagram illustrating associated signal processed by the voltage regulator according to the embodiment of the present invention.

The controlling circuit 230 comprises resistors r1~r7 and transistors m1~m4. The resistor r1 is connected between the power voltage Vcc and a node c. The resistor r2 is connected between the node c and a node d. The resistor r3 is arranged between the node d and the ground voltage GND. That is, the resistors r1, r2 and r3 are connected between the power voltage Vcc and the ground voltage GND, and collaboratively formed as a voltage divider. Consequently, the node c generates the reference voltage Vrn, and the node d generates the reference voltage Vrp.

The gate terminal of the transistor m1 is connected with the node d. A first terminal of the transistor m1 is connected with the power voltage Vcc. The resistor r4 is connected with a second terminal of the transistor m1 and the ground voltage GND. A gate terminal of the transistor m2 is connected with a second terminal of the transistor m1. A first terminal of the transistor m2 is connected with the power voltage Vcc. The resistor r5 is connected between a second terminal of the transistor m2 and the ground voltage GND. Moreover, the second terminal of the transistor m2 generates the power start control signal Ctrh.

The gate terminal of the transistor m3 is connected with the node c. A first terminal of the transistor m3 is connected with the ground voltage GND. The resistor r6 is connected with a second terminal of the transistor m3 and the power voltage Vcc. A gate terminal of the transistor m4 is connected with the second terminal of the transistor m3. A first terminal of the transistor m4 is connected with the ground voltage GND. The resistor r7 is connected between a second terminal of the transistor m4 and the power voltage Vcc. Moreover, the second terminal of the transistor m4 generates the power start control signal Ctrl.

Please refer to FIG. 3B. At the time point to, the voltage regulator 200 is powered on. Consequently, the power voltage Vcc is gradually increased from 0V to 3.3V.

The time interval between the time point t0 and the time point t1 is a transient period. The duration of the time interval is about 10 ms~20 ms. In the transient period, the power voltage Vcc is gradually increased, and the reference voltage Vrn at the node c and the reference voltage Vrp at the node d are gradually increased. Meanwhile, the voltage of the node c is insufficient to turn on the transistor m3, and the voltage of the node d is insufficient to turn on the transistor m1.

Since the transistor m3 is turned off, the transistor m4 is turned on. Meanwhile, the power start control signal Ctrl is substantially equal to the ground voltage GND (0V). That is, the P-type transistor Mp2 of the source voltage generator 220 is turned on in response to a low voltage level. Since the transistor m1 is turned off, the transistor m2 is turned on. Meanwhile, the power start control signal Ctrh is substantially equal to the power voltage Vcc. That is, the N-type transistor Mn1 of the sink voltage generator 210 is turned on in response to a high voltage level.

After the time point t1, the voltage regulator 200 is in a normal working state. Meanwhile, the voltage of the node c is sufficient to turn on the transistor m3, and the voltage of the node d is sufficient to turn on the transistor m1.

Since the transistor m3 is turned on, the transistor m4 is turned off. Meanwhile, the power start control signal Ctrl is substantially equal to the power voltage Vcc. That is, the P-type transistor Mp2 of the source voltage generator 220 is turned off in response to the high voltage level. Since the transistor m1 is turned on, the transistor m2 is turned off. Meanwhile, the power start control signal Ctrh is equal to the ground voltage GND (0V). That is, the N-type transistor Mn1 of the sink voltage generator 210 is turned off in response to the low voltage level.

According to the reference voltage Vrn, the source voltage Vse generated by the source voltage generator 220 is maintained at about 1.8V. According to the reference voltage Vrp, the sink voltage Vsk generated by the sink voltage generator 210 is gradually increased from 0V to 1.5V.

It is noted that the sink voltage generator 210, the source voltage generator 220 and the controlling circuit 230 of the voltage regulator 200 may be modified while retaining the teaching of the present invention.

Figure 4A:
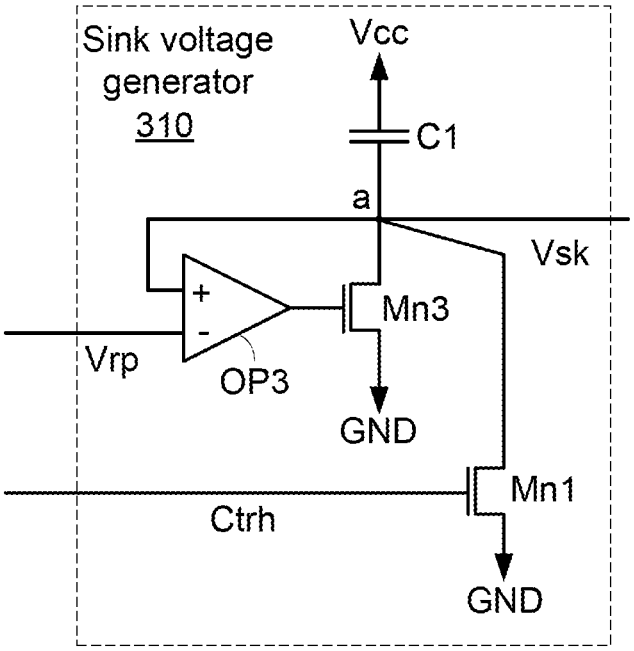
FIG. 4A is a schematic circuit diagram illustrating a variant example of the sink voltage generator of the voltage regulator according to the embodiment of the present invention.

FIG. 4A is a schematic circuit diagram illustrating a variant example of the sink voltage generator of the voltage regulator according to the embodiment of the present invention. In comparison with the sink voltage generator 210 of FIG. 2, the connection between the operational amplifier OP3 and a transistor Mn3 of the sink voltage generator 310 is distinguished. The other aspects of the sink voltage generator 310 are similar to those of the sink voltage generator 210 of FIG. 2, and are not redundantly described herein.

A negative input terminal of the operational amplifier OP3 receives a reference voltage Vrp. A positive terminal of the operational amplifier OP3 is connected with a node a. The gate terminal of the transistor Mn3 is connected with an output terminal of the operational amplifier OP3. A first terminal of the transistor Mn3 is connected with the node a. A second terminal of the transistor Mn3 is connected with the ground voltage GND. Since the operational amplifier OP3 and the transistor Mn3 are in a negative feedback connection, the sink voltage Vsk is equal to the reference voltage Vrp.

Figure 4B:
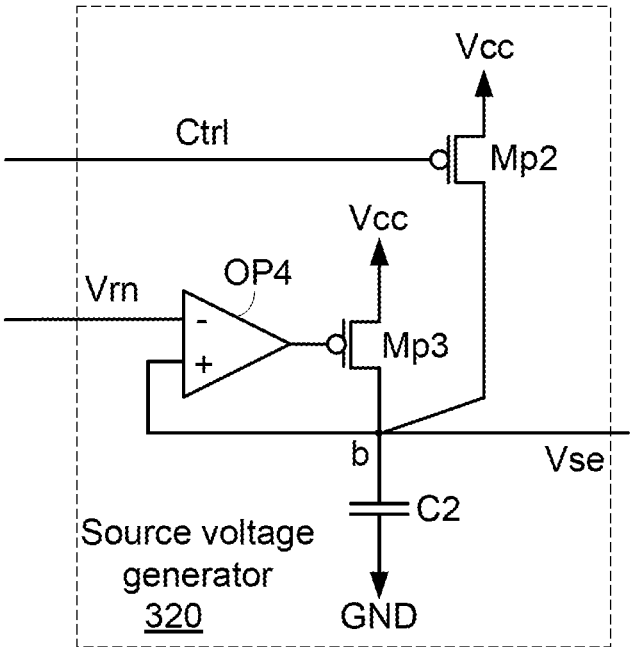
FIG. 4B is a schematic circuit diagram illustrating a variant example of the source voltage generator of the voltage regulator according to the embodiment of the present invention.

FIG. 4B is a schematic circuit diagram illustrating a variant example of the source voltage generator of the voltage regulator according to the embodiment of the present invention. In comparison with the source voltage generator 220 of FIG. 2, the connection between the operational amplifier OP4 and a transistor Mp3 of the source voltage generator 320 is distinguished. The other aspects of the source voltage generator 320 are similar to those of the source voltage generator 220 of FIG. 2, and are not redundantly described herein.

A negative input terminal of the operational amplifier OP4 receives a reference voltage Vrm. A positive terminal of the operational amplifier OP4 is connected with a node b. The gate terminal of the transistor Mp3 is connected with an output terminal of the operational amplifier OP4. A first terminal of the transistor Mp3 is connected with the node b. A second terminal of the transistor Mp3 is connected with the power voltage Vcc. Since the operational amplifier OP4 and the transistor Mp3 are in a negative feedback connection, the source voltage Vse is equal to the reference voltage Vrn.

Figure 4C:
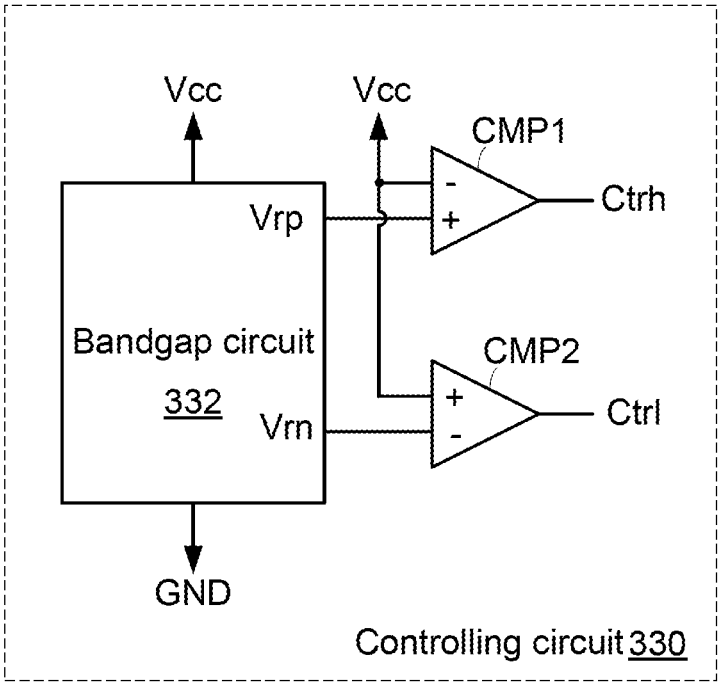
FIG. 4C is a schematic circuit diagram illustrating a variant example of the controlling circuit of the voltage regulator according to the embodiment of the present invention.

FIG. 4C is a schematic circuit diagram illustrating a variant example of the controlling circuit of the voltage regulator according to the embodiment of the present invention. The controlling circuit 330 further comprises a bandgap circuit 332, a first comparing circuit CMP1 and a second comparing circuit CMP2.

The bandgap circuit 332 can accurately output the reference voltages Vrp and Vrn. A positive input terminal of the first comparing circuit CMP1 receives the reference voltage Vrp. A negative input terminal of the first comparing circuit CMP1 receives the power voltage Vcc. An output terminal of the first comparing circuit CMP1 generates the power start control signal Ctrh. A negative input terminal of the second comparing circuit CMP2 receives the reference voltage Vrn. A positive terminal of the second comparing circuit CMP2 receives the power voltage Vcc. An output terminal of the second comparing circuit CMP2 generates the power start control signal Ctrl.

Similarly, after the voltage regulator 200 is powered on and during a transient period of the voltage regulator 200, the controlling circuit 330 activates the power start control signals Ctrh and Ctrl. Since the transistor Mn1 of the sink voltage generator 210 or 310 is turned on, the ground voltage GND is temporarily used as the sink voltage Vsk by the sink voltage generator 210 or 310. Moreover, since the transistor Mp2 of the source voltage generator 220 or 320 is turned on, the power voltage Vcc is temporarily used as the source voltage Vse by the source voltage generator 220 or 320.

During the normal operations of the voltage regulator 200, the controlling circuit 330 inactivates the power start control signals Ctrh and Ctrl. Moreover, the controlling circuit 330 provides the reference voltages Vrp and Vrn to the sink voltage generator 210 or 310 and the source voltage generator 220 or 320, respectively. According to the reference voltage Vrp, the sink voltage generator 210 or 310 generates the sink voltage Vsk. According to the reference voltage Vrn, the source voltage generator 220 or 320 generates the source voltage Vse.

Generally, the sink voltage generator, the source voltage generator and the controlling circuit of the voltage regulator of different examples may be combined with each other to generate the sink voltage Vsk and the source voltage Vse. For example, in an embodiment, the controlling circuit 230 of FIG. 3A, the sink voltage generator 310 of FIG. 4A and the voltage regulator 200 of FIG. 2 cooperate with each other to generate the sink voltage Vsk and the source voltage Vse.

From the above descriptions, the present invention provides a voltage regulator. The voltage regulator provides the sink voltage Vsk and the source voltage Vse to the cascade I/O circuit. Consequently, the voltage between any two terminals of the transistor of the cascade I/O circuit does not exceed the withstanding voltage range. That is, the transistors of the cascade I/O circuit can be normally operated.

In the above embodiments, the power voltage Vcc is 3.3V and the withstanding voltage of the transistor is 1.8V. It is noted that the magnitudes of the power voltage and the withstanding voltage may be altered according to the practical requirements. For example, in another embodiment, the power voltage Vcc is 5.0V and the withstanding voltage of the transistor is 3.3V.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A voltage regulator connected with an input/output circuit, the voltage regulator comprising:

a controlling circuit generating a first reference voltage, a second reference voltage, a first power start control signal and a second power start control signal;

a sink voltage generator receiving the first reference voltage and the first power start control signal; and a source voltage generator receiving the second reference voltage and the second power start control signal, wherein when the voltage regulator is in a normal working state, the controlling circuit inactivates the first power start control signal and the second power start control signal, the sink voltage generator generates a sink voltage according to the first reference voltage, and the source voltage generator generates a source voltage according to the second reference voltage.

2. The voltage regulator as claimed in claim 1, wherein the input/output circuit comprises:

a pull-up circuit receiving a power voltage and the sink voltage, so that an operating voltage of the pull-up circuit is in a range between the power voltage and the sink voltage; and a pull-down circuit receiving the source voltage and a ground voltage, so that an operating voltage of the pull-down circuit is in a range between the source voltage and the ground voltage.

3. The voltage regulator as claimed in claim 2, wherein the pull-up circuit comprises a first P-type transistor and a second P-type transistor in a cascade connection, wherein the first P-type transistor and the second P-type transistor are connected between the power voltage and an output pad, a gate terminal of the first P-type transistor receives a first gate signal, and a gate terminal of the second P-type transistor receives a second gate signal.

4. The voltage regulator as claimed in claim 3, wherein the pull-down circuit comprises a first N-type transistor and a second N-type transistor in a cascade connection, wherein the first N-type transistor and the second N-type transistor are connected between the ground voltage and the output pad, a gate terminal of the first N-type transistor receives a third gate signal, and a gate terminal of the second N-type transistor receives a fourth gate signal.

5. The voltage regulator as claimed in claim 1, wherein before the normal working state and during a transient period, the controlling circuit activates the first power start control signal and the second power start control signal, so that a ground voltage is used as the sink voltage by the sink voltage generator and a power voltage is used as the source voltage by the source voltage generator.

6. The voltage regulator as claimed in claim 5, wherein the sink voltage generator comprises:

an operational amplifier, wherein a first input terminal of the operational amplifier receives the first reference voltage, and a second input terminal of the operational amplifier is connected with a node a;

a first transistor, wherein a gate terminal of the first transistor is connected with an output terminal of the operational amplifier, a first terminal of the first transistor is connected with the node a, and a second terminal of the first transistor receives the ground voltage;

a capacitor connected between the power voltage and the node a; and a second transistor, wherein a gate terminal of the second transistor receives the first power start control signal, a first terminal of the second transistor is connected with the node a, and a second terminal of the second transistor receives the ground voltage.

7. The voltage regulator as claimed in claim 5, wherein the sink voltage generator comprises:

an operational amplifier, wherein a first input terminal of the operational amplifier receives the second reference voltage, and a second input terminal of the operational amplifier is connected with a node b;

a first transistor, wherein a gate terminal of the first transistor is connected with an output terminal of the operational amplifier, a first terminal of the first transistor is connected with the node b, and a second terminal of the first transistor receives the power voltage;

a capacitor connected between the ground voltage and the node b; and a second transistor, wherein a gate terminal of the second transistor receives the second power start control signal, a first terminal of the second transistor is connected with the node b, and a second terminal of the second transistor receives the power voltage.

8. The voltage regulator as claimed in claim 5, wherein the controlling circuit comprises:

a bandgap circuit generating the first reference voltage and the second reference voltage;

a first comparing circuit, wherein a first input terminal of the first comparing circuit receives the power voltage, a second input terminal of the first comparing circuit receives the first reference voltage, and an output terminal of the first comparing circuit generates the first power start control signal; and a second comparing circuit, wherein a first input terminal of the second comparing circuit receives the power voltage, a second input terminal of the second comparing circuit receives the second reference voltage, and an output terminal of the second comparing circuit generates the second power start control signal.

9. The voltage regulator as claimed in claim 5, wherein the controlling circuit comprises:

a first resistor connected between the power voltage and a node c;

a second resistor connected between the node c and a node d;

a third resistor connected between the node d and the ground voltage, wherein the node d generates the first reference voltage, and the node c generates the second reference voltage;

a first transistor, wherein a gate terminal of the first transistor is connected with the node d, and a first terminal of the first transistor receives the power voltage;

a fourth resistor connected between a second terminal of the first transistor and the ground voltage;

a second transistor, wherein a gate terminal of the second transistor is connected with a second terminal of the first transistor, and a first terminal of the second transistor receives the power voltage;

a fifth resistor connected between a second terminal of the second transistor and the ground voltage, wherein the second terminal of the second transistor generates the first power start control signal;

a third transistor, wherein a gate terminal of the third transistor is connected with the node c, and a first terminal of the third transistor receives the ground voltage;

a sixth resistor connected between a second terminal of the third transistor and the power voltage;

a fourth transistor, wherein a gate terminal of the fourth transistor is connected with the second terminal of the third transistor, and a first terminal of the fourth transistor receives the ground voltage; and a seventh resistor connected between a second terminal of the fourth transistor and the power voltage, wherein the second terminal of the fourth transistor generates the second power start control signal.

* * * * *